United States Patent [19]

Ishimoto

[11] Patent Number: 4,717,366

[45] Date of Patent: Jan. 5, 1988

[54] DISGUISING TOY CAR

[75] Inventor: Zenichi Ishimoto, Tokyo, Japan

[73] Assignee: Nikko Co., Ltd., Tokyo, Japan

[21] Appl. No.: 878,172

[22] Filed: Jun. 25, 1986

[51] Int. Cl.[4] ..... A63H 17/26

[52] U.S. Cl. ..... 446/470; 446/438; 446/485

[58] Field of Search ..... 446/470, 438, 439, 485; 296/210, 216; 362/65

[56] References Cited

U.S. PATENT DOCUMENTS

| | | | |
|---|---|---|---|
| 2,312,005 | 2/1943 | Smith | 362/65 |
| 3,284,623 | 11/1966 | Neal | 362/65 |
| 4,160,494 | 7/1979 | McCambridge | 446/470 X |
| 4,246,628 | 1/1981 | Ikemizu et al. | 362/65 |
| 4,282,561 | 8/1981 | Yano | 362/65 |
| 4,380,789 | 4/1983 | Craig | 362/65 |
| 4,477,999 | 10/1984 | Harigai et al. | 446/470 |

*Primary Examiner*—Philip C. Kannan

[57] ABSTRACT

A disguisable toy car is disclosed, which in a part of the car body is provided with an opening for mounting a rotatable disguising mechanism which is preferably formed with a rotatable element having two disguising faces, one of which is flat and normally covers the opening so as to blend-in with the contour of the car body, while the other face extends outwardly of the car body and includes a patrol-lighting fixture and being selectively positionable within the opening for altering the appearance of the car body.

4 Claims, 6 Drawing Figures

DISGUISING TOY CAR

FIELD OF THE INVENTION

This invention relates to a toy car, more particularly to a disguising toy car incorporating a mechanism for enabling a change in appearance of a portion of the car body through a remote control system.

BACKGROUND OF THE INVENTION

Heretofore, there have been proposed various tupes of remote controllable toy cars in order to alter, for example, its running direction, and to achieve up-and-down or swing motion, depending on car types.

Those conventional toy cars, however could merely be driven or automatically operated to fulfill their mechanisms intrinsic car driving function, and thus were not intended to provide other forms of unique operation. Special types of cars having a large body size have been used where unique operation was desired but this increased the manufacturing costs of such special car types.

Accordingly, an object of the invention is to provide a novel type of a disguising toy car provided with a rotatable element at a body portion of a conventional car body, which when rotated by a remote control will alter the outer body appearance at said body portion.

SUMMARY OF THE INVENTION

In order to achieve the above object, a disguising toy car according to the invention includes a car body provided with an opening in which is arranged a rotatable disguising mechanism.

The disguising mechanism preferably comprises a rotatable element having first and second faces, said rotatable element being elastically supported within the opening for normally exposing the first face within said opening in the car body so as to blend in with the shape of the car body, while said second face of the rotatable element when exposed within said opening, through operation of an electric motor against an elastic force, also closing the opening but presenting a non-blending shape.

In the disguising toy car according to the invention, the rotatable disguising mechanism may be operated by remote control, such as a conventional radio-control system, a system using fiber optics or lead wires.

The invention will be described herein-below in more detail for its preferred embodiments with reference to the accompanying drawings.

PREFERRED EMBODIMENTS OF THE INVENTION

Figure 1:
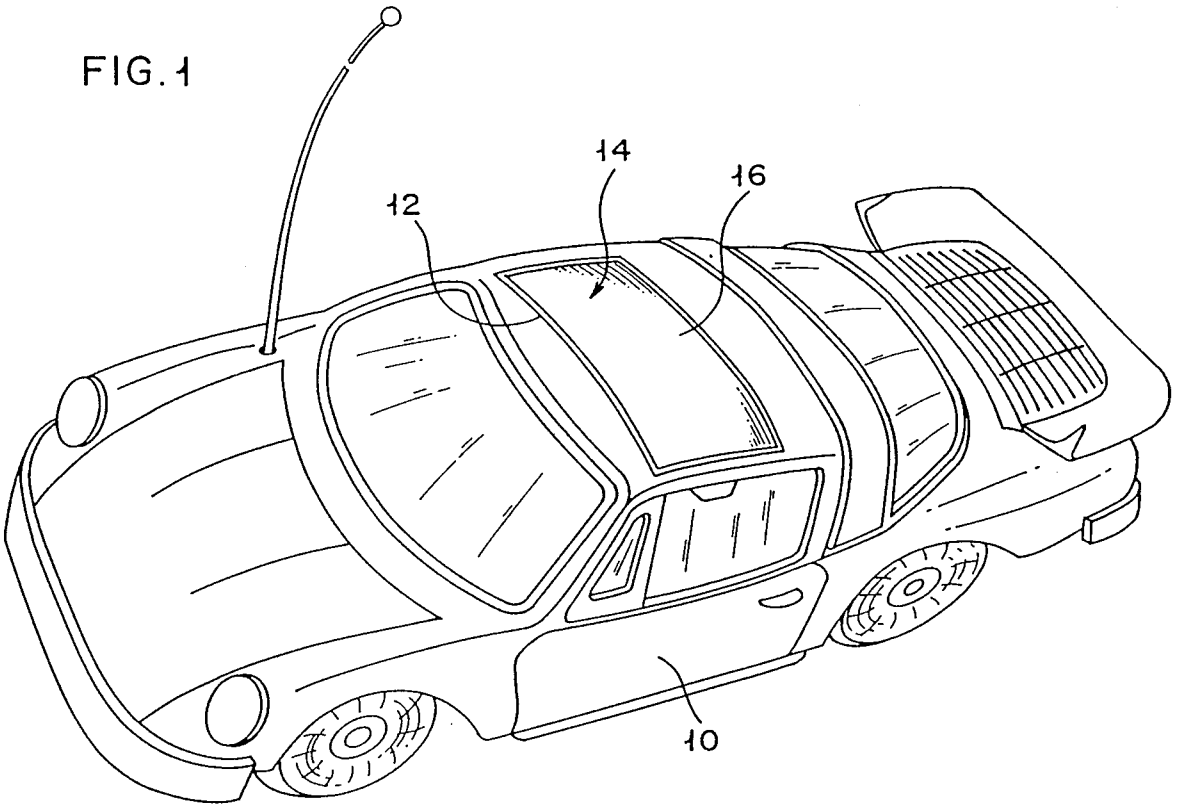
FIG. 1 is a perspective view of one embodiment of the disguising toy car according to the invention.
Figure 2:
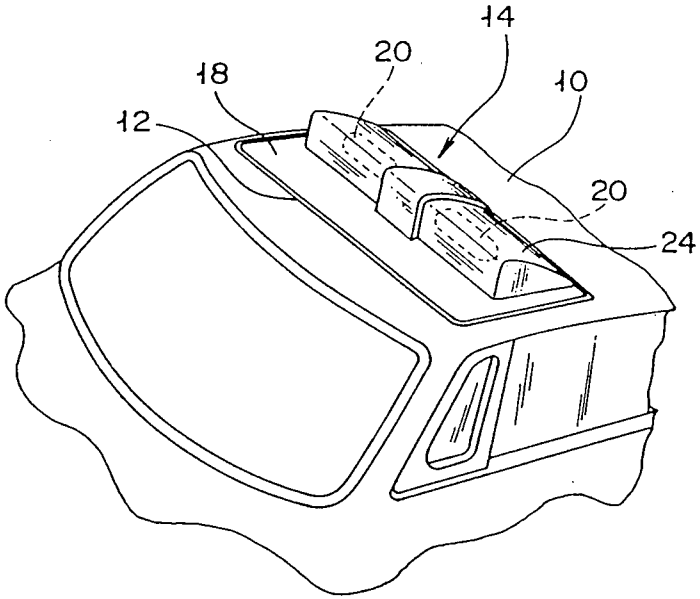
FIG. 2 is a perspective view of a portion of the disguising toy car in FIG. 1, showing a normal operational position of its disguising mechanism.
Figure 3:
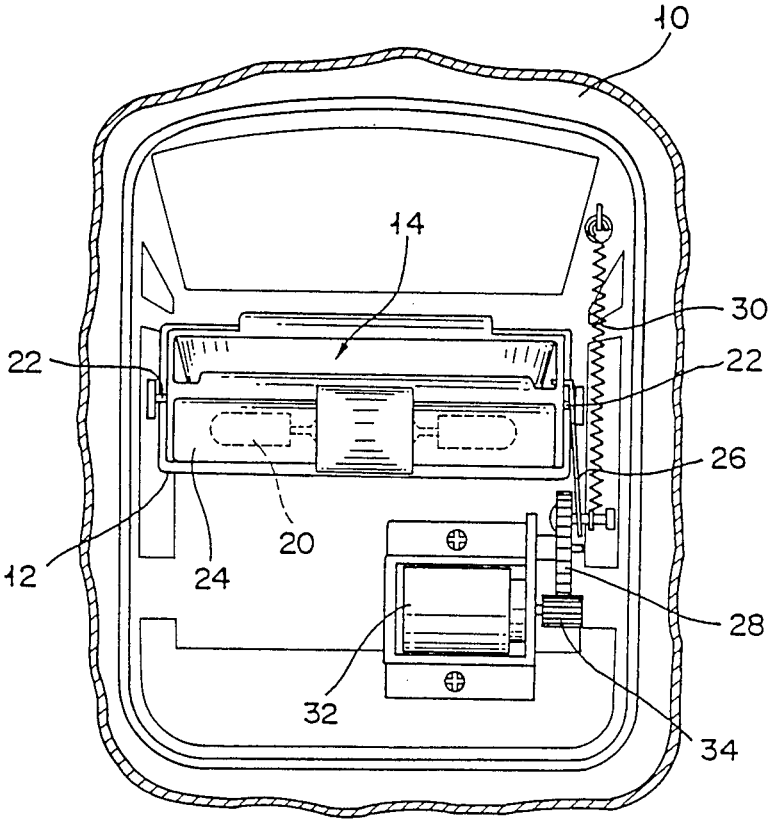
FIG. 3 is a bottom plan view of the structure of the disguising mechanism of the toy car shown in FIG. 1.

FIGS. 1 to 3 show one embodiment of the disguising toy car according to the invention, wherein FIG. 1 is a perspective view showing a normal appearance of the toy car, FIG. 2 is a perspective view of the same body portion showing another appearance, e.g. a disguise appearance, and FIG. 3 illustrates the structure of the disguising mechanism. Referring to this embodiment, the disguising toy car according to the invention is provided with a car body 10 having an opening 12 in its top, and within which is arranged a disguising mechanism comprising a rotatable element 14 having two faces. One face of the rotatable element 14 forms a first face 16 being normally flat, as shown in FIG. 1, so as to blend-in with the car body shape while the other face forms a second face 18 mounting a patrol-lighting fixture which is externally exposable as seen in FIG. 2 by remote instructions. Internally of the second face 18 there are arranged lamps 20 which may turn on and off when the second face 18 is exposed to the outside.

A driving means for the rotatable element 14 of the invention will now be described with reference to FIG. 3. The rotatable element 14 essentially has a triangular form in section and extends transversely across the top of the car with its longitudinal ends pivotally supported at pivots 22 extending from the car body 10 for enabling the first and second faces 16, 18 to be alternately exposed to the outside. The second face 18 is provided with a patrol-lighting fixture 24 containing therein lamps 20 which may be operated to turn on and off at will. In the described embodiment, a pulling means 26 is provided for pulling the rotatable element 14 in its rotatable direction, one end of which pulling means 26 is engaged with a portion of the rotatable element while the other end is operationally engaged with a portion of a reversible gear 28. Thus, the reversible movement of the gear 28 enables the first and the second faces 16, 18 of the rotatable element 14 to be exposed alternately in opening 12 of the car body 10. Further, in this embodiment, the reversible gear 28 is engaged with a spiral pulling spring 30, one end of which is secured to the car body for normally exposing the first face 16 of the rotatable element 14 within the opening 12 to the outside. The reversible gear 28, on the other hand, is meshed with a driving gear 34 of an electric motor 32 for rotating the gear 28 against an elastic force of the pulling spring 30.

Figure 4:
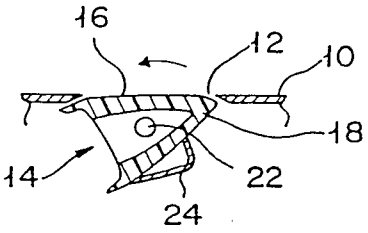
FIGS. 4 to 6 are schematic sectional views of the disguising mechanism shown in FIGS. 1 to 3, in various stages of its operation.
Figure 5:
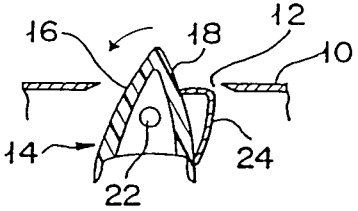
Figure 6:
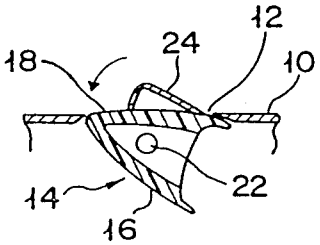

By remotely energizing the electric motor 32 of the disguising mechanism, the reversible gear 28 may be rotated in a selected direction for allowing the first face 16 of the rotatable element 14 to or the second face 18 thereof to be exposed in the opening 12 of the car body 10, resulting in a changed or disguised appearance of the toy car (see FIGS. 4 to 6).

It will be appreciated from the above description that the toy car according to the invention is provided with at least two mechanisms of a rotary type, resulting in a very interesting disguisable toy car of simple structure which may be operated by a conventional remote control means. One of the mechanisms is a conventional direction-changing mechanism while the other is the disguising mechanism in accordance with the invention, both mechanisms of rotary type, being operatively controlled by a remote control system using a radio-transmitter/receiver, fiber optics or conductor wires.

Although the invention has been described hereinabove with respect to a single embodiment, of simple construction, it will be appreciated that the invention is not limited thereto and is thus applicable to other structures of more complicated designs and functions. Thus such changes and modifications are understood to be included within the scope of the present invention.

What is claimed is:

1. A disguising toy car, which comprises a car body of a predetermined width and shape and having a longitudinal axis and a body portion formed with an opening extending transversely of said longitudinal axis substantially across the width of the car body, a rotatable disguising mechanism arranged in said opening and comprising a rotatable element having first and second faces and being elastically supported for normally exposing, through an elastic force generated by the elastic support, said first face in said opening of the car body for blending-in with the shape of the car body, said second face of the rotatable element being exposed in said opening on rotating said rotatable element by an electric motor against said elastic force, said second face extending outwardly of the car body to impart to said car body a shape different from that provided by said first face, said rotatable disguising mechanism being operated by remote control.

2. A disguising toy car, which comprises a car body having a body portion formed with an opening in which is mounted a rotatable disguising mechanism comprising a rotatable element having first and second faces, means for elastically supporting said disguising mechanism for normally exposing said first face in said opening for blending with the body contour and comprising a spring having an elastic force and connected at one end to the car body, drivable means to which an opposite end of the spring is connected and a pulling element operatively connected at one of its ends to said disguising mechanism and at its opposite end to said drivable means, said second face, when exposed in said opening, extending outwardly beyond the normal exposure of the first face, when in said opening, said second face being exposed in said opening, instead of said first face, on operating an electric motor operatively connected to said drivable means to drive said drivable means against said elastic force of said spring and effectively changing thereby the general appearance of the toy car when said second face is exposed in said opening.

3. A disguising toy car according to claim 2, wherein said drivable means comprises a reversible gear.

4. A disguising toy car according to claim 2, wherein said opening is provided in a top body portion of the toy car having a longitudinal axis, said opening in said top body portion extending transversely of said longitudinal axis across substantially the width of the car body.

* * * * *